US009616284B1

(12) United States Patent
Aganyan et al.

(10) Patent No.: US 9,616,284 B1
(45) Date of Patent: Apr. 11, 2017

(54) PORTABLE MULTI-FUNCTIONAL UPRIGHT BODY STRETCHING APPARATUS

(71) Applicant: Aganyan Inc., Van Nuys, CA (US)

(72) Inventors: Hakop Aganyan, Los Angeles, CA (US); Vernald Aganov, Los Angeles, CA (US); Ashot Arzunyan, Glendale, CA (US); Vagarshak Pilossyan, Los Angeles, CA (US)

(73) Assignee: Aganyan Inc., Van Nuys, CA (US)

( * ) Notice: Subject to any disclaimer, the term of this patent is extended or adjusted under 35 U.S.C. 154(b) by 0 days.

(21) Appl. No.: 15/246,806

(22) Filed: Aug. 25, 2016

(51) Int. Cl.

| | |
|---|---|
| ***A63B 21/002*** | (2006.01) |
| ***A63B 21/068*** | (2006.01) |
| ***A63B 26/00*** | (2006.01) |
| ***A63B 23/00*** | (2006.01) |
| ***A63B 21/00*** | (2006.01) |
| ***A63B 23/035*** | (2006.01) |
| ***A63B 23/02*** | (2006.01) |
| *A61H 1/02* | (2006.01) |

(52) U.S. Cl.
CPC ..... *A63B 23/00* (2013.01); *A63B 21/0004* (2013.01); *A63B 21/4035* (2015.10); *A63B 23/0211* (2013.01); *A63B 23/03525* (2013.01); *A61H 1/02* (2013.01); *A61H 1/0218* (2013.01); *A61H 1/0292* (2013.01); *A61H 2203/0481* (2013.01); *A61H 2203/0487* (2013.01); *A63B 21/068* (2013.01); *A63B 23/02* (2013.01); *A63B 23/0205* (2013.01); *A63B 23/0238* (2013.01); *A63B 2023/006* (2013.01); *A63B 2208/029* (2013.01); *A63B 2208/0285* (2013.01)

(58) Field of Classification Search
CPC ... A63B 7/00; A63B 21/068; A63B 2023/006; A63B 23/0211; A63B 23/0238; A63B 23/02; A63B 23/0205; A63B 23/0216; A63B 22/0087; A63B 2208/0285; A63B 2208/029; A63B 2208/0257; A61H 1/02; A61H 1/0292; A61H 1/0218; A61H 1/0229; A61H 3/008; A61H 2203/0481; A61H 2203/0487; A61G 7/1082; A61G 7/1086; A61G 7/1092
See application file for complete search history.

(56) References Cited

U.S. PATENT DOCUMENTS 3,353,532 A * 11/1967 Ellis ..... A61H 1/0218 606/241
3,491,385 A * 1/1970 Werner ..... A61G 13/00 5/633

(Continued)

*Primary Examiner* — Joshua Lee
(74) *Attorney, Agent, or Firm* — Georgiy L. Khayet

(57) ABSTRACT

An apparatus for stretching comprises a body holder for connecting to a support device (e.g., a frame or ball joint). The body holder includes a body support panel for receiving an upper portion of user's body, a left arm holder for receiving a left arm, and a right arm holder for receiving a right arm. The left arm holder and the right arm holder are pivotally connected to the body support panel. The body support panel can have an ergonomic curved surface to approximate a part of user's torso. The left arm holder can also have a curved surface to approximate a portion of left side of a user's torso and at least a portion of left arm. Similarly, the right arm holder can have has a curved surface to approximate at least a portion of right side of the user's torso and at least a portion of right arm.

23 Claims, 7 Drawing Sheets

(56) References Cited

U.S. PATENT DOCUMENTS 3,976,155 A * 8/1976 Esch ..... E04F 21/22 182/116
4,157,593 A * 6/1979 Kristensson ..... A61G 7/1019 5/87.1
4,611,806 A * 9/1986 Terry ..... A63B 23/0233 482/142
4,678,187 A * 7/1987 Prsala ..... A63B 21/055 482/130
4,838,250 A * 6/1989 Angelo ..... A63B 23/0233 482/142
4,896,659 A * 1/1990 Goldish ..... A61H 1/0218 602/19
5,001,789 A * 3/1991 Schoenberger ..... A61G 7/1017 5/87.1
5,018,512 A * 5/1991 Dolan ..... A61H 1/0229 482/143
5,031,898 A * 7/1991 Anthony ..... A61H 1/0218 482/70
5,033,459 A * 7/1991 Burton ..... A61H 1/0218 606/241
5,080,352 A * 1/1992 Freed ..... A63B 21/00047 482/140
5,105,803 A * 4/1992 Burton ..... A61H 1/0218 482/143
5,135,459 A * 8/1992 Perry, Jr. ..... A63B 21/00047 482/144
5,217,487 A * 6/1993 Engel ..... A61H 1/0292 482/142
5,233,708 A * 8/1993 Winston, Sr. ..... A61G 7/1038 280/47.25
5,282,834 A * 2/1994 Remy ..... A61H 1/02 128/845
5,472,401 A * 12/1995 Rouillard ..... A63B 23/0233 482/142
5,489,258 A * 2/1996 Wohnsen ..... A61G 5/14 280/250.1
5,600,857 A * 2/1997 Heilmann ..... A61G 5/00 5/81.1 R
5,794,286 A * 8/1998 Scott ..... A61G 13/009 128/845
5,840,001 A * 11/1998 Schedel ..... A61H 1/0218 482/130
5,922,011 A * 7/1999 Cuccia ..... A61H 1/0229 606/241
5,971,901 A * 10/1999 Shaw ..... A61H 1/0218 482/142
6,106,490 A * 8/2000 Shaw ..... A61H 1/0229 482/142
6,308,981 B1 * 10/2001 Proehl ..... A61G 7/1017 280/47.34
6,547,809 B1 * 4/2003 Cuccia ..... A61G 13/009 606/241
6,827,676 B2 * 12/2004 Kuo ..... A63B 21/04 482/121
7,087,005 B2 * 8/2006 Rouillard ..... A61H 1/0292 482/142
7,182,084 B2 * 2/2007 Cleveland ..... A61G 5/00 128/845
7,591,769 B1 * 9/2009 Benjamin ..... A63B 21/068 482/131
7,691,041 B2 * 4/2010 Abdo ..... A63B 21/0552 482/142
8,033,960 B1 * 10/2011 Dalebout ..... A63B 21/00065 482/123
8,172,737 B1 * 5/2012 Nihlman ..... A63B 23/03575 482/100
8,177,695 B2 * 5/2012 Dellino ..... A63B 21/00065 482/140
8,491,450 B2 * 7/2013 Perry, Jr. ..... A61H 1/0218 482/142
9,010,775 B1 * 4/2015 Palmer ..... A61G 5/14 280/87.021
9,295,597 B2 * 3/2016 Hjort ..... A61G 5/14
9,375,599 B1 * 6/2016 Simmons ..... A63B 21/0085
2002/0128125 A1 * 9/2002 Simmons ..... A63B 21/4047 482/93
2002/0128131 A1 * 9/2002 Wu ..... A63B 23/02 482/142
2003/0130696 A1 * 7/2003 Hurd ..... A61H 1/0292 606/240
2003/0216781 A1 * 11/2003 Cuccia ..... A61G 13/009 606/237
2003/0216782 A1 * 11/2003 Cuccia ..... A61G 13/009 606/242
2007/0085405 A1 * 4/2007 Grotner ..... A61G 7/1007 297/423.11
2007/0232464 A1 * 10/2007 Chu ..... A63B 21/00072 482/96
2007/0259760 A1 * 11/2007 Perez ..... A63B 21/068 482/140
2008/0176716 A1 * 7/2008 Boren ..... A61H 1/0218 482/51
2008/0227609 A1 * 9/2008 Barniak ..... A63B 3/00 482/142
2010/0004100 A1 * 1/2010 Rahimi ..... A61H 1/0229 482/96
2011/0277235 A1 * 11/2011 Okumatsu ..... A61G 7/1017 5/83.1
2012/0104711 A1 * 5/2012 Alexander ..... A61G 5/00 280/47.34
2012/0122638 A1 * 5/2012 Cares ..... A63B 21/0023 482/145
2012/0165168 A1 * 6/2012 Simmons ..... A63B 21/0615 482/139
2013/0244836 A1 * 9/2013 Maughan ..... A63B 21/1645 482/40
2013/0253582 A1 * 9/2013 Tielve ..... A61H 1/0292 606/240
2014/0011648 A1 * 1/2014 Carney ..... A63B 21/00181 482/142
2014/0323278 A1 * 10/2014 McBride ..... A61H 1/0229 482/142
2016/0081872 A1 * 3/2016 Samson ..... A61H 1/0292 602/36
2016/0296792 A1 * 10/2016 Mosher ..... A63B 23/0238

* cited by examiner

PORTABLE MULTI-FUNCTIONAL UPRIGHT BODY STRETCHING APPARATUS

BACKGROUND

Technical Field

This disclosure generally relates to an apparatus and method for stretching and exercising a human body. More particularly, this disclosure relates to an apparatus for gravity-assisted stretching of a human body, particularly upright stretching of at least a portion of the user's torso, including one or more lumbar muscles and muscles of pelvic region of the user. This disclosure also relates to a method of manufacturing the apparatus for gravity-assisted stretching. Moreover, this disclosure concerns a method of using the apparatus for gravity-assisted upright stretching of at least a lower back of the user and decompression of one or more herniated discs of the user.

Description of Related Art

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

Today, the market offers a numerous devices for stretching a human body, particularly devices for stretching a lower back of human body. These devices can be mechanical or electromechanical and employ various methods for stretching and exercising their users. Some of the devices use the concept of weight resistance, while others can use plyometric resistance or gravity assistance in implementing their stretching therapy functions.

One of most common devices for stretching is an inversion therapy device. The inversion therapy device operates by inverting the human body of the user and suspending him in an upside down position for a predetermined period. In this position, the spine and related muscles can be unloaded, relaxed, and stretched to achieve positive treatment effects. Unfortunately, the inversion therapy devices are uncomfortable and difficult to operate, especially for those who suffer from overweight. Moreover, oftentimes, the inversion therapy devices can be dangerous or even harmful for the users.

While in an upside down position, the heart of the user slows down, while the blood pressure is increased. These effects can cause the heart to move blood through the body at a force greater than it is used to do. People suffering from hypertension or other heart-related disorders may develop unwanted medical conditions while using the inversion therapy device. For example, the inversion therapy devices can cause a stroke for people with hypertension. It was also found that the inversion therapy causes elevated pressure in the eyes and exacerbates such conditions as glaucoma or retinal detachment. In addition, the inversion therapy devices can also increase a pressure in an inner ear, which may cause discomfort or aggravate ear-related health problems.

SUMMARY

This section is provided to introduce a selection of concepts in a simplified form that are further described below in the Detailed Description section. This summary is not intended to identify key features or essential features of the claimed subject matter, nor is it intended to be used as an aid in determining the scope of the claimed subject matter.

According to one aspect of the disclosure, there is provided an apparatus for stretching. The apparatus comprises a body holder for connecting to a support device such as a frame or a joint ball. The body holder includes a body support panel for receiving an upper front portion of a body of a user, a left arm holder for receiving a left arm of the user, and a right arm holder for receiving a right arm of the user. In some embodiments, the left arm holder can be pivotally connected to the body support panel and the right arm holder can be pivotally connected to the body support panel. In certain embodiments, the body support panel, the left arm holder, and the right arm holder are provided as a single unit. In an alternative embodiment, the body support panel, the left arm holder, and the right arm holder are provided as separate and individual components interconnected directly or indirectly.

At least one of the body support panel, the left arm holder, and the right arm holder can have an ergonomic shape to match the user's body. Specifically, the body support panel can have a curved surface to approximate a front part of a torso of the user. The body support panel can further include a first padded cushion, the left arm holder can include a second padded cushion, and the right arm holder can include a third padded cushion. The body support panel, the left arm holder, and the right arm holder can include a padded cushion covering all of these elements. In some embodiments, the left arm holder has a curved surface to approximate at least a portion of a left side of a torso of the user and to approximate at least a portion of a left arm of the user. The curved surface of the left arm holder can further approximate at least a portion of a left forearm of the user. Similarly, the right arm holder can have a curved surface to approximate at least a portion of a right side of a torso of the user and to approximate at least a portion of a right arm of the user. The curved surface of the right arm holder can further approximate at least a portion of a right forearm of the user.

In certain embodiments, the apparatus for stretching can include the support device, which can include the frame, joint ball, or any other movable or non-movable structure (e.g., a piece of furniture).

In some embodiments, the body holder is configured to be titled from about 90 degrees relative to a horizontal ground level to about 0 degrees relative to the horizontal ground level. In some embodiments, the body holder can be also configured to rotate sideways.

In certain embodiments, the frame further includes one or more handles arranged substantially near the left arm holder and the right arm holder enabling the user to grab the one or more handles during a stretching exercise. The frame can also include one or more foot supports. The frame can include a base and an upper portion of the frame pivotally connected to the base and configured to arrange and fix the upper portion of the frame in a tilted state. The upper portion of the frame can include two girders pivotally connected to the base, a crossbar fixed to the girders, and a tilt adjuster. The tilt adjuster cab include a rod, where a lower portion of the rod is pivotally connected to the base, a slider for receiving an upper portion of the rod, where the slider is pivotally connected to the crossbar, and a fixer configured to affix the slider to the rod so as to exclude their relative movement.

In some embodiments, the body holder is configured to hang on one or more of the following: a band, a chain, a cable, a rope, and a beam. Moreover, in yet additional embodiments, the body holder is pivotally connected to the frame. The body support panel can further include a support member connected to the frame for preventing breaking the body support panel when in use by the user.

According to another aspect of the disclosure, there is provided a method for manufacturing an apparatus for stretching. The method comprises the steps of providing a support device (e.g., a frame or ball joint) and providing a body holder for connecting to the support device. The body holder includes a body support panel for receiving an upper front portion of a body of a user, a left arm holder for receiving a left arm of the user, and a right arm holder for receiving a right arm of the user. The left arm holder configured for connecting to the body support panel, while the right arm holder is configured for connecting to the body support panel. The left arm holder has a curved surface to approximate at least a portion of a left side of a torso of the user and to approximate at least a portion of a left arm of the user. Similarly, the right arm holder has a curved surface to approximate at least a portion of a right side of a torso of the user and to approximate at least a portion of a right arm of the user.

The method further comprises the steps of connecting the body holder to the support device, pivotally connecting the left arm holder to the body support panel, pivotally connecting the right arm holder to the body support panel, and adjusting a tilted angle of the body holder relative to a ground level or the support device.

According to yet another aspect of the disclosure, there is provided a method for exercising a body of a user using an apparatus for stretching. The method for exercising comprises the steps of providing a support device and providing a body holder connected to the support device. The body holder includes a body support panel for receiving an upper front portion of a body of a user, a left arm holder for receiving a left arm of the user, and a right arm holder for receiving a right arm of the user. The left arm holder configured for connecting to the body support panel, while the right arm holder is configured for connecting to the body support panel. The left arm holder has a curved surface to approximate at least a portion of a left side of a torso of the user and to approximate at least a portion of a left arm of the user. Similarly, the right arm holder has a curved surface to approximate at least a portion of a right side of a torso of the user and to approximate at least a portion of a right arm of the user. The method for exercising further comprises the steps of enabling the user to arrange a front portion of a torso of the user onto the body support panel, enabling the user to arrange the left arm and a left forearm onto the left arm holder, enabling the user to arrange the right arm and a right forearm onto the right arm holder, rotating or adjusting the left arm holder towards the torso of the user such that the left arm holder receives at least the portion of the left side of the torso of the user, rotating or adjusting the right arm holder towards the torso of the user such that the right arm holder receives at least the portion of the right side of the torso of the user, enabling the user to grab at least one handle on the support device, and enabling the user to stretch at least a portion of lumbar muscles of the user using a gravity force.

Additional objects, advantages, and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

Embodiments are illustrated by way of example and not limitation in the figures of the accompanying drawings, in which like references indicate similar elements and in which.

DETAILED DESCRIPTION OF EXAMPLE EMBODIMENTS

Introduction

Figure 1:
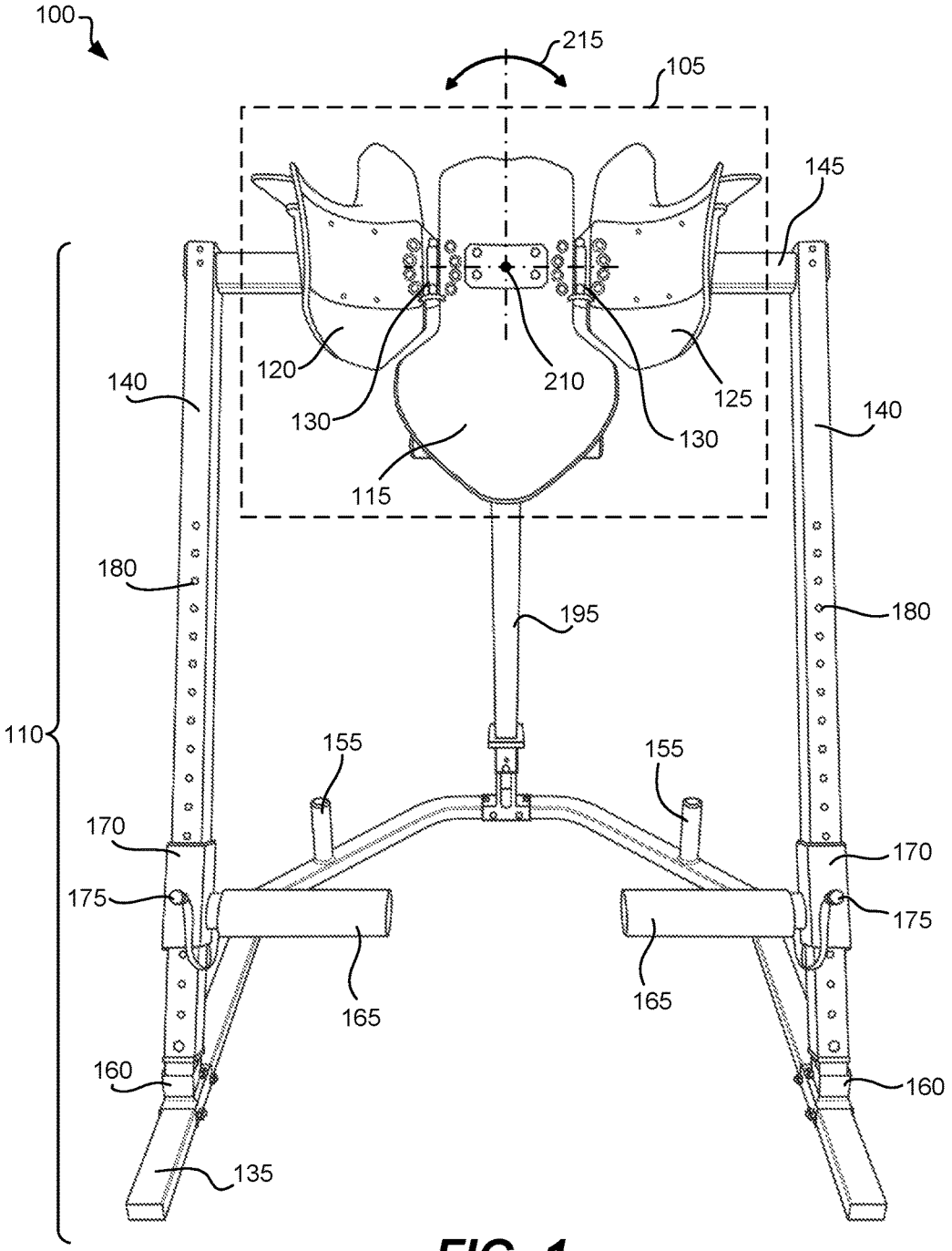
FIG. 1 shows a front view of an apparatus for stretching according to one example embodiment.

The present teachings generally relate to an apparatus for gravity-assisted stretching of at least a portion of a user's torso. Particularly, the apparatus is configured to enable stretching one or more lumbar muscles or one or more muscles of a pelvic region of the user. The apparatus is also configured to provide decompression of one or more herniated discs in the lower back of the user. The apparatus includes a body holder that can be affixed to a frame or any other suitable assembly. The frame can be arranged on a ground, floor, wall, ceiling, or any other non-movable structure. The body holder is generally configured to hold an upper portion of user's torso such as the lower portion of the user's torso hangs and is stretched by a gravity force. The concept of the apparatus is similar to the manner how a human holds a curved bottle in his hand.

The body holder is configured to at least partially "wrap" the upper body of the user and hold it while the user is relaxing muscles and stretching his torso using gravity. The user can control the apparatus to adjust a tilt of the body holder and his positions. The relaxed lumber muscles permit the user to stretch the spine and decompress discs in an upright position. The apparatus can enable stretching at different spinal axis angles. For example, the user can set a tilted position in a range from about 0 degrees to about 90 degrees relative to a ground level. Different angles and combinations of gravity help to decompress herniated or ruptured discs thereby releasing a pinched nerve in the lower back.

The instant apparatus can be used for therapy purposes and for body exercising purposes. The apparatus can help improving a posture, blood flow, and provide a relief from back pain. Because the user is in control of the apparatus and all movements, the user is also in control of exact positioning of his body. Thus, the apparatus is more effective, easier, and safer to operate than known prior art devices.

The following detailed description of embodiments includes references to the accompanying drawings, which form a part of the detailed description. Approaches described in this section are not prior art to the claims and are not admitted to be prior art by inclusion in this section. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical and operational changes can be made without departing from the scope of what is claimed. The following detailed description is, therefore, not to be taken in a limiting sense, and the scope is defined by the appended claims and their equivalents.

For purposes of this patent document, the terms "or" and "and" shall mean "and/or" unless stated otherwise or clearly intended otherwise by the context of their use. The term "a" shall mean "one or more" unless stated otherwise or where the use of "one or more" is clearly inappropriate. The terms "comprise," "comprising," "include," and "including" are interchangeable and not intended to be limiting. For example, the term "including" shall be interpreted to mean "including, but not limited to."

Additionally, all ranges provided herein include the upper and lower values of the range unless explicitly noted. For example, the term "about" shall mean a reasonable deviation of a value accompanying this term. If it is not specified otherwise, the term "about" may refer to a variation of 10% from an indicated value. In the case of a range of values, the term "about" may refer to a 10% variation from both the lower and upper limits of the range.

Moreover, it shall be understood that when an element is referred to as being "on" or "connected" or "coupled" to another element, it can be directly on or connected or coupled to the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," and so forth). Spatially relative terms, such as "beneath," "below," "lower," "above," "upper" and the like may be used to describe an element or feature's relationship to another element(s) and/or feature(s) as, for example, illustrated in the drawings. It shall be appreciated the spatially relative terms are intended to encompass different orientations of the apparatus for stretching or its elements in use in addition to the orientation depicted in the figures. For example, if the apparatus for stretching or any of its components in the drawings is turned over, elements described as "below" and/or "beneath" other elements or features would then be oriented "above" the other elements or features. The apparatus for stretching or its components may be otherwise oriented (e.g., rotated 90 degrees or at other orientations) and the spatially relative descriptors used herein interpreted accordingly.

The term "pivot" shall be construed to mean any device or mechanism that provides pivoting motion and which movably (rotatably) connects two or more elements. The term "pivot" shall also encompass such mechanisms as joints, hinges, coupler, junctures, knuckles, links, and so forth. All these terms can be used interchangeably and mean the same. The term "pivotally" shall be construed to mean connection of two or more elements using one or more pivots.

The term "user" shall be construed to mean any individual, human, or animal using the apparatus for stretching according to any embodiment described herein. The term "user" shall also encompass a patient, client, customer, and the like.

EXAMPLE EMBODIMENTS

Now, exemplary embodiments are described with reference to the drawings. The drawings are schematic illustrations of idealized example embodiments. As such, variations from the shapes of the illustrations as a result, for example, of manufacturing techniques or tolerances, are to be expected. Thus, example embodiments discussed herein should not be construed as limited to the particular shapes of regions illustrated herein but are to include deviations in shapes that result, for example, from manufacturing.

Figure 2:
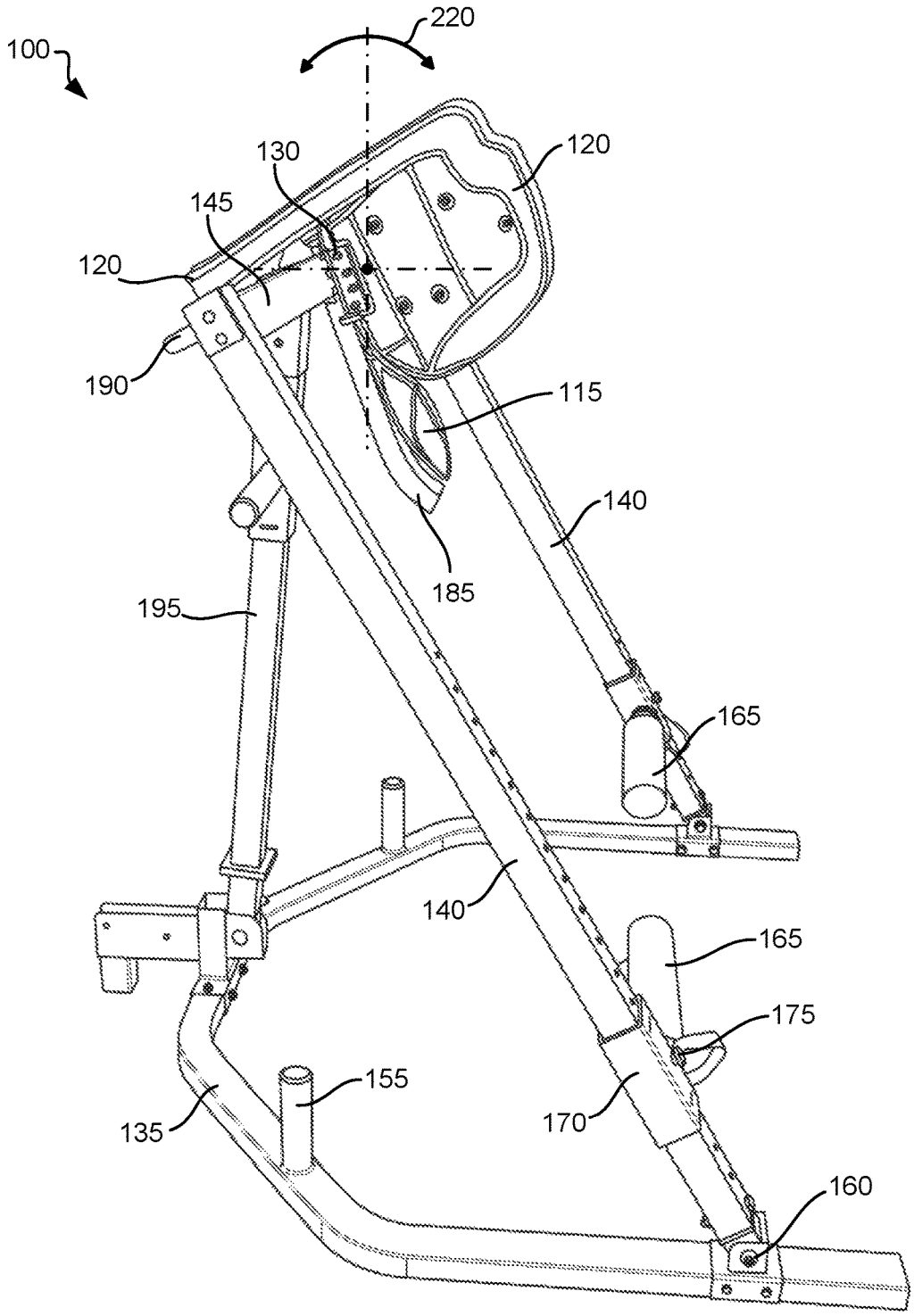
FIG. 2 shows a side view of the apparatus for stretching.
Figure 3:
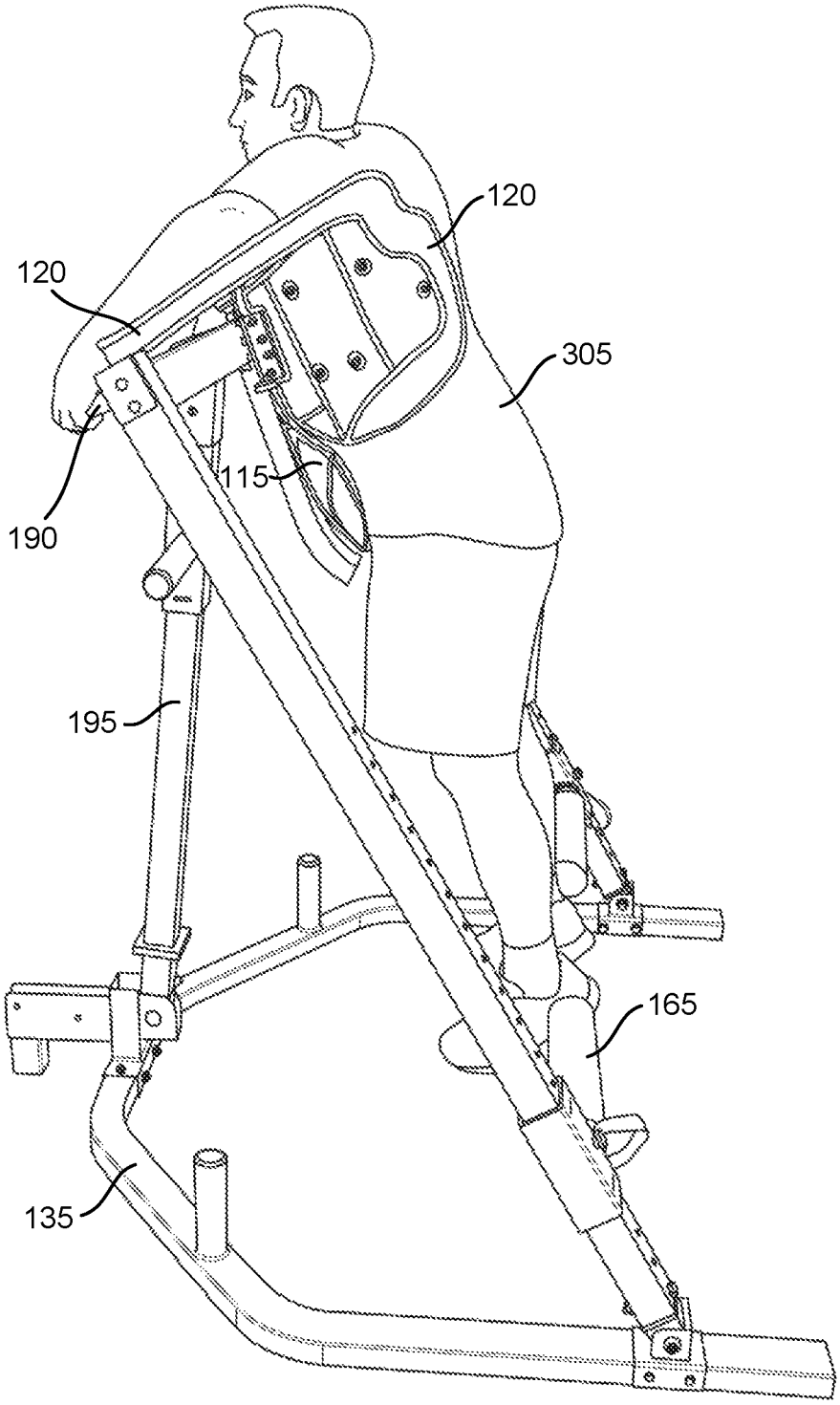
FIG. 3 shows a side view of the apparatus for stretching as in FIG. 2 and also a user using the apparatus for stretching.
Figure 4:
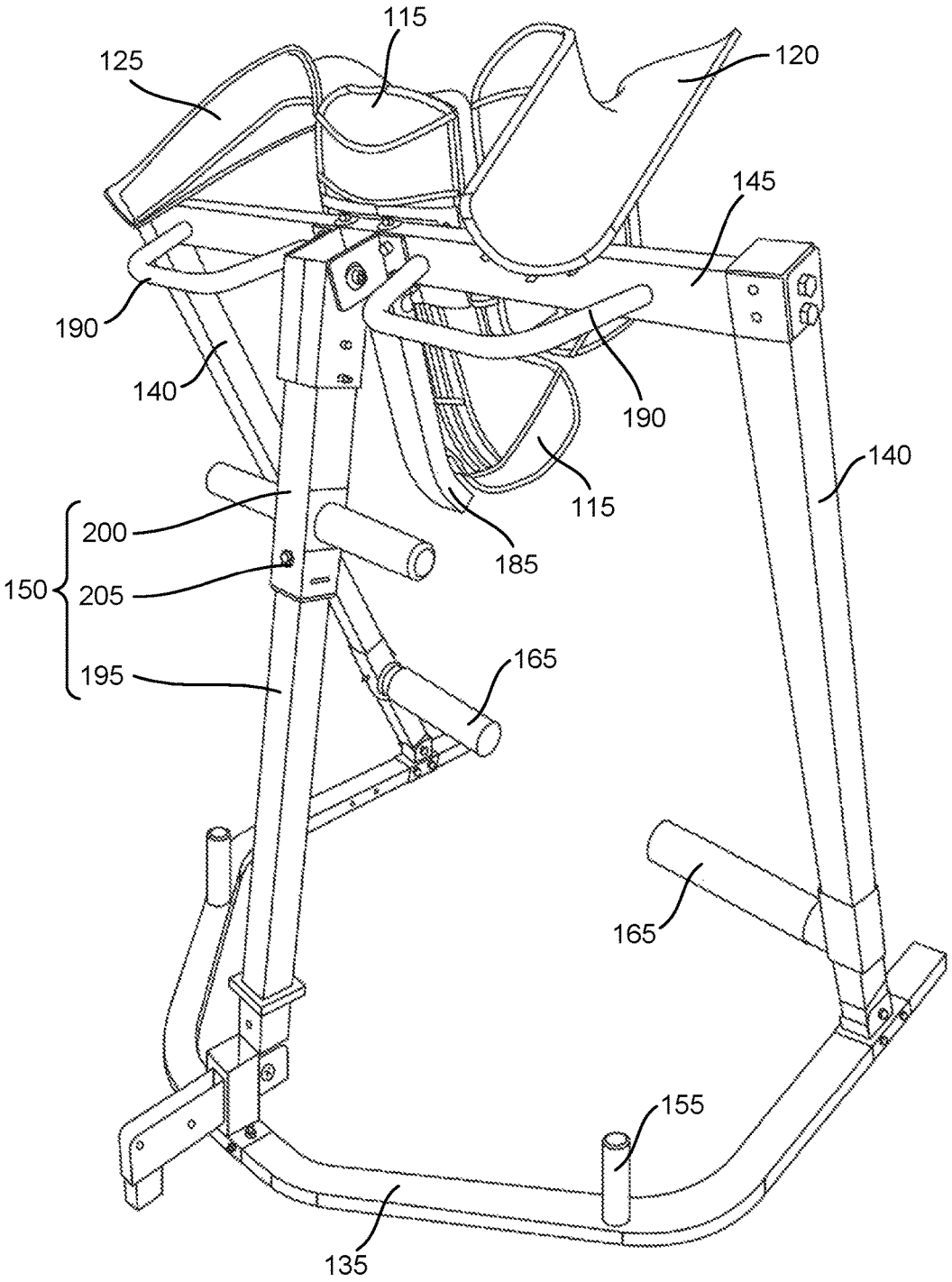
FIG. 4 shows a back plan view of the apparatus for stretching.
Figure 5:
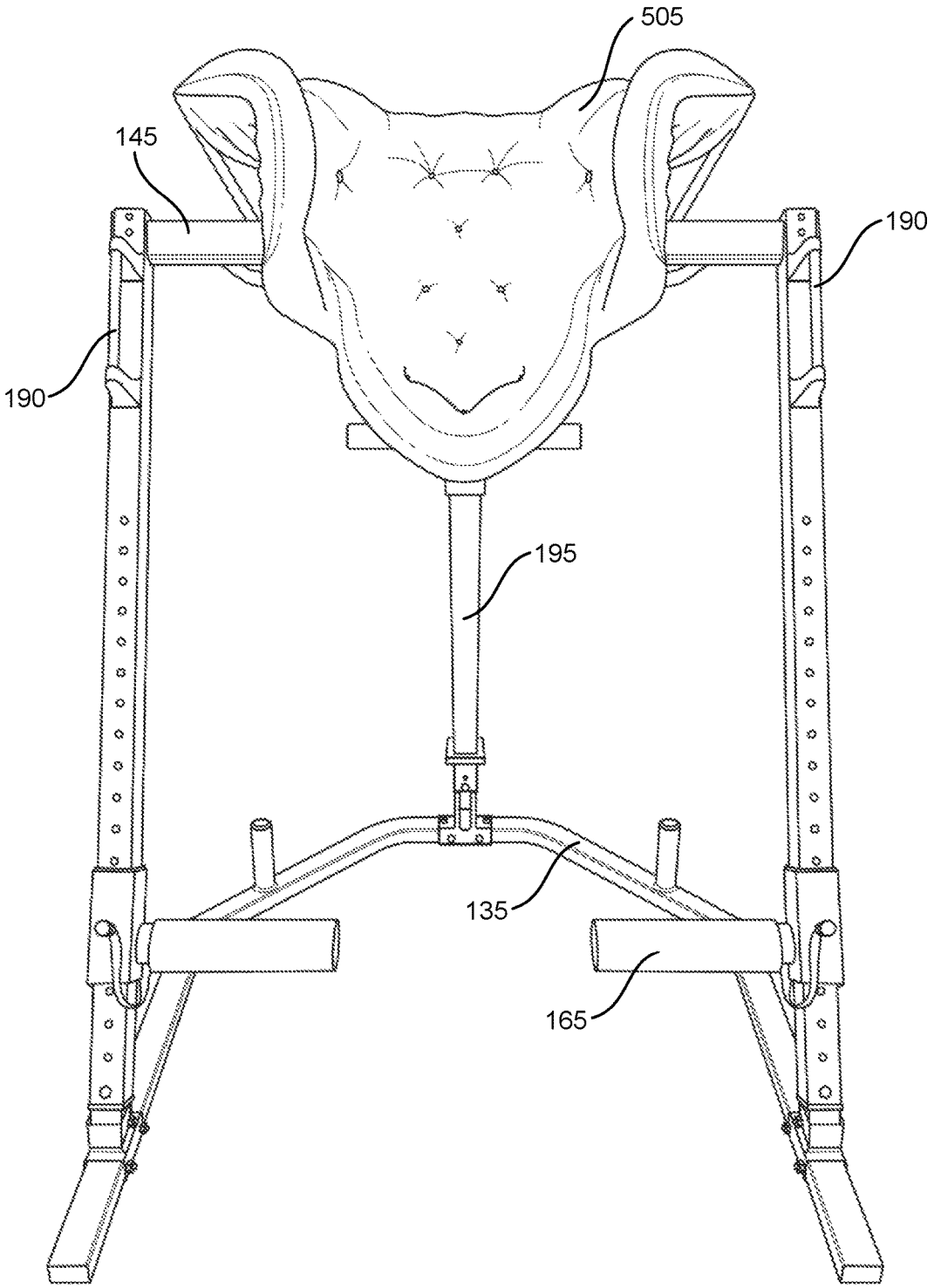
FIG. 5 shows a front view of the apparatus for stretching which includes a padded cushion according to one example embodiment.

FIG. 1 shows a front view of an apparatus 100 for stretching according to one example embodiment. FIG. 2 shows a side view of the same apparatus 100. FIG. 3 shows the side view of the apparatus 100 as in FIG. 2 and also shows a user 305 using the apparatus 100. FIG. 4 shows a back plan view of the apparatus 100 for stretching. FIG. 5 shows a front view of the apparatus 100 for stretching which includes a padded cushion according to one example embodiment.

As shown in these drawings, the apparatus 100 includes a body holder 105 and a support device such as a frame 110. It should be understood that the body holder can be of the shape other than that shown in the drawings. For example, the body holder can have a shape or design of an upper garment such as a shirt (with sleeves or sleeveless), a blouse (with sleeves or sleeveless), a jacket (with sleeves or sleeveless), a t-shirt (with sleeves or sleeveless), or any other garment or wearable structure having an ergonomic shape to receive the user's upper body. The upper garment can be made of hard and/or durable materials such as polymers or fiberglass or any other materials like metal, polymer, fiberglass, heavy-duty synthetic fabrics, cotton, or any combinations thereof. Furthermore, the body holder can have a shape or design of an upper garment and be affixed to any suitable assembly or hanged directly by ropes, cables, wires, or chains. The upper garment can be made of hard and/or durable materials such as polymers or fiberglass or any other materials like metal, polymer, fiberglass, heavy-duty synthetic fabrics, cotton, or any combinations thereof.

Although the embodiments discussed below provide that the body holder 105 is connected to the frame 110, it should be understood that the body holder 105 can be directly or indirectly connected to the support device of other types. For example, the support device can include a piece of furniture such as a table (including a surgical table), a chair, and a bench. In some embodiments, the support device can include a ball (including a ball joint), a part of a building (e.g., a wall, floor, ceiling, doorframe, etc.), at least a part of sports or fitness equipment, and so forth. In yet further embodiments, the support device can include one or more ropes, cables, wires, beams, or chains utilized to couple the body holder 105 to any suitable structure (e.g., a portion of a building such a ceiling or doorframe).

The body holder 105 can be removably attached to the frame 110. In some embodiments, the body holder 105 can be pivotally (or rotatably) attached to the frame 110. In yet more embodiments, the body holder 105 is directly connected to the frame 110. In other embodiments, the body holder 105 is indirectly connected to the frame 110 via one or more intervening elements or devices, such as a tilt adjusting device. The frame 110 can be arranged on a floor or a ground. In other embodiments, however, the frame 110 can be configured to be secured to a wall, ceiling or any other structure or constructional element of a building. In other embodiments, however, the body holder 105 can be hung on one or more of the following: a band, a chain, a cable, a rope, and a beam.

The body holder 105 includes three main elements: a body support panel 115, a left arm holder 120, and a right arm holder 125. The body support panel 115 can be configured to receive at least an upper front portion of a body of a user 305. The left arm holder 120 is configured to receive at least a left arm of the user 305. The right arm holder 125 is configured to receive at least a right arm of the user 305. The left arm holder 120 is directly or indirectly connected to the body support panel 115, and, similarly, the right arm holder 125 is directly or indirectly connected to the body support panel 115. In some embodiments, the left arm holder 120 and the right arm holder 125 are pivotally connected to the body support panel 115 using one or more pivots, joints, hinges (collectively referred herein to as a "pivot" 130 as discussed above). In other embodiments, the left arm holder 120 and the right arm holder 125 are directly connected to the body support panel 115 such that the left arm holder 120 and the right arm holder 125 can resiliently extend or bend.

As shown in the drawings, the left arm holder 120 and the right arm holder 125 can provide support to arms of the user to relieve a negative pressure. In some additional embodiments, the left arm holder 120 and the right arm holder 125 may lack support of the user's arms and forearms, instead only supporting the underarms of the user.

In some embodiments, the pivots 130 can include a spring (e.g., a pull-back spring) such that the user 305 can individually place the left arm holder 120 and the right arm holder 125 onto the sides of his torso. In some additional embodiments, the pivots 130 can include at least one locking (fixing) mechanism or pins. In yet further embodiments, there can be provided additional mechanisms to mechanically or electronically move or rotate the left arm holder 120 and the right arm holder 125.

The body support panel 115 can be flat or ergonomic. For example, the body support panel 115 can have a curved surface to approximate a front part of a torso of the user. As shown in the drawings, the body support panel 115 can have a gutter-like shape with extended walls at its lower portion. The body support panel 115 can be manufactured from any of the following materials: metal, polymer, heavy-duty synthetic fabrics, fiberglass, cotton, or any combinations thereof. In certain embodiments, the body support panel 115 includes a padded cushion for comfort of the user.

The left arm holder 120 can be ergonomic, meaning it has a curved surface to approximate at least a portion of a left side of a torso of the user 305. Moreover, the curved surface of the left arm holder 120 approximates at least a portion of the left arm of the user 305 and optionally at least a portion of a left forearm of the user 305. Similarly, the right arm holder 125 can be ergonomic, meaning it has a curved surface to approximate at least a portion of a right side of the torso of the user 305. Moreover, the curved surface of the right arm holder 125 approximates at least a portion of the right arm of the user 305 and optionally at least a portion of a right forearm of the user 305. More specifically, as shown in the drawings, each of the left arm holder 120 and the right arm holder 125 has a complex shape of two connecting gutter-like elements connected substantially in perpendicular towards one another. One of the gutter-like elements partially wraps a portion of the torso's side of the user, while another gutter-like element is for holding the arms and forearms of the user 305. In some embodiments, both the left arm holder 120 and the right arm holder 125 can be made from any of the following materials: metal, polymer, fiberglass, heavy-duty synthetic fabrics, cotton, or any combinations thereof. In certain embodiments, both the left arm holder 120 and the right arm holder 125 can include padded cushions for the comfort of the user 305. In some embodiments, such as shown in FIG. 5, the body support panel 115, the left arm holder 120, and the right arm holder 125 can include a padded cushion 505 covering all of these elements.

In yet further embodiments, the body support panel 115 can be equipped with means for supporting the head of the user 305. For example, the body support panel 115 can include a chin holder or cervical collar provided around an upper portion of the body support panel 115.

In certain embodiments, the body holder 105 or its elements can be manufactured in different sizes to accommodate needs of people of different sizes and weights. For example, the body holder 105 or its elements can be of an extra small size, small size, medium size, large size, extra-large size, and so forth.

In certain additional embodiments, the body support panel 115, the left arm holder 120, and the right arm holder 125 can be manufactured as a single whole. In this example, the left arm holder 120 and the right arm holder 125 can be bendable and resiliently move with respect to the body support panel 115. In alternative embodiments, the body support panel 115, the left arm holder 120, and the right arm holder 125 can be provided as individual and separate elements which are configured to be directly or indirectly connected to each other, for example, as shown in the drawings.

The frame 110 includes a base 135 and an upper portion of the frame pivotally connected to the base 135 and configured to arrange and fix the upper portion of the frame in a tilted state relative to a ground level or the base 135. Particularly, the upper portion of the frame 110 includes two girders 140 pivotally connected to the base 135, a crossbar 145 fixed to the girders 140, and a tilt adjuster 150.

The base 135 can be made of a profiled metal like a metal pipe or from suitable polymer materials. The base 135 can have any suitable shape to support the upper portion of the frame. For example, the base 135 can be a U-shaped as shown in the drawings, although the base 135 can be of any other shape, including a circle, square, rectangle, and so forth. In some embodiments, the base 135 can have elements enabling the user 305 to secure the base 135 to a floor. For example, the base 135 can have one or more openings enabling to place screws or bolts through them for attaching the base 135 to the floor. Moreover, the base 135 can be provided with one or more optional pegs 155 for holding one or more weight plates.

The girders 140 can be of any suitable shape and design. The girders 140 can also refer to rods, beams, pipes, or any other frame elements. The girders 140 can be made of a profiled metal or polymer materials. The lower portions of the girders 140 are pivotally connected to the base 135 via one or more hinges 160. The hinges 160 can also refer to pivots, joints, couplers, and the like. The upper portions of the girders 140 are connected with each other via the crossbar 145.

The girders 140 can be also provided with one or more foot supports 165. Each of the foot supports 165 can include a rod for supporting a user's foot. The rod of the foot supports 165 is connected to a slider 170 for sliding along the girder 140. Each of the foot supports 165 also includes an insert 175 for inserting in one of openings 180 arranged in the girders 140 for fixing the slider 170 onto the girder 140.

In some embodiments, the body support panel 115 can be connected to the crossbar 145. Moreover, in certain embodiments, the body support panel 115 can include a support member 185 directly or indirectly connected to the frame 110 for preventing breaking the body support panel 115 when in use by the user 305. The support member 185 can be implemented from metal or polymer materials, and it can be arranged substantially between the crossbar 145 and the body support panel 115. In some embodiments, the body support panel 115 can integrate the support member 185. The support member 185 can also reinforce the body support panel 115 and prevent it damaging.

In further embodiments, the frame 110 can be provided with one or more handles 190 arranged substantially near the left arm holder 120 and the right arm holder 125 enabling the user 305 to grab the one or more handles 190 during a stretching exercise. As shown in the drawings, the handles 190 can be provided on the crossbar 145 near the left arm holder 120 and the right arm holder 125.

As shown in FIG. 4, the tilt adjuster 150 includes a rod 195, a slider 200, and a fixer 205. The rod 195 can be made of metal or polymer materials and include one or more openings. A lower portion of the rod 195 can be pivotally connected to the base 135. The slider 200 can be implemented as a hollow tube, pipe or cylinder, and configured to receive the upper portion of the rod 195. The slider is also pivotally connected to the crossbar 145. The fixer 205, such as a pin, is configured to affix the slider 200 to the rod 195 so as to exclude their relative movement. For example, the fixer 205 is inserted into at least one of the openings of the rod 195.

Thus, the tilt adjuster 150 enables to adjust and tilt the body holder 105 from about 90 degrees relative to a horizontal ground level to about 0 degrees relative to the horizontal ground level (see tilt direction 220 in FIG. 2). More preferably, however, the body holder 105 is tilted from about 60 degrees relative to the horizontal ground level to about 0 degrees relative to the horizontal ground level. In some embodiments, any tilted position of the body holder 105 can be fixed by the tilt adjuster 150 or any other device. In certain embodiments, the frame may lack the tilt adjuster 150, but the body holder 105 can be connected to the frame (or another support structure) via a pivot mechanism or a joint, which may allow the body holder 105 to tilt or rotate into any preferred position.

In certain embodiments, the body holder 105 can also tilt or rotate sideways. As shown in FIG. 1, the body holder 105 can be configured to rotate sideways around a central axis 210. The rotation can be performed towards the right or left side (see rotational direction 215) to any suitable angle. For example, the body holder 105 can be configured to rotate sideways from about −90 degrees to about +90 degrees relative to a vertical axis. In some embodiments, the body holder 105 can be configured to fix the rotated position. For example, the body holder 105 can be rotated and fixed at 5-degree increments selected from the following: 90 degrees, 85 degrees, 80 degrees, 75 degrees, 60 degrees, 55 degrees, 50 degrees, 45 degrees, 40 degrees, 35 degrees, 30 degrees, 25 degrees, 20 degrees, 15 degrees, 10 degrees, 5 degrees, 0 degree, −90 degrees, −85 degrees, −80 degrees, −75 degrees, −60 degrees, −55 degrees, −50 degrees, −45 degrees, −40 degrees, −35 degrees, −30 degrees, −25 degrees, −20 degrees, −15 degrees, −10 degrees, and −5 degrees. In certain embodiments, the body holder 105 can also be configured to move up and down, or sideways, or forward and backward, with respect to the support device such as the frame 110.

In some additional embodiments, the body holder 105 can be of the shape other than shown in the drawings. For example, the body holder 105 can have a shape or design of an upper garment such as a shirt (with sleeves or sleeveless), a blouse (with sleeves or sleeveless), a jacket (with sleeves or sleeveless), a t-shirt (with sleeves or sleeveless), or any other garment or wearable structure having an ergonomic shape to receive the user's upper body. The upper garment can be made of hard and/or durable materials such as polymers or fiberglass.

In certain embodiments, the body holder 105 or the apparatus 100 for stretching can include elements for securing a user's body to the body holder 105. These elements can include Velcro or Velcro-like materials, fabric hook, loop fasteners, and so forth.

Figure 6:
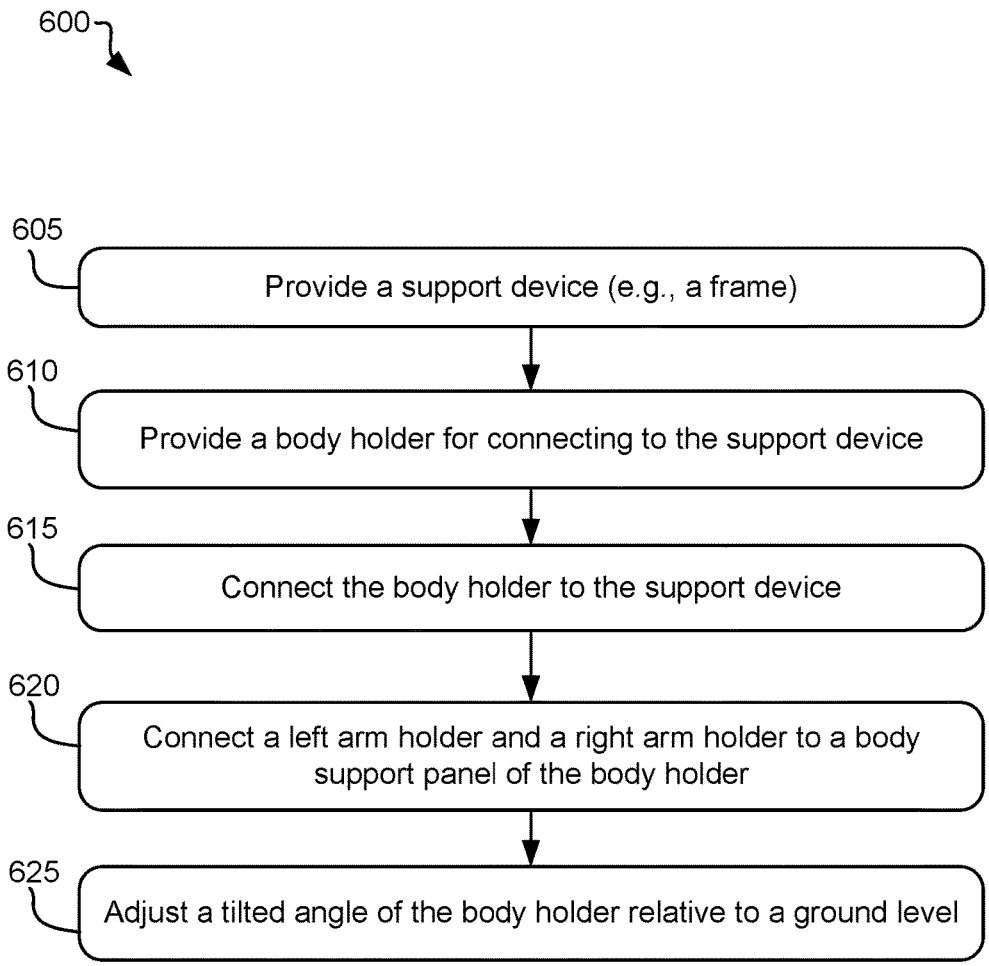
FIG. 6 is a process flow diagram showing a method for manufacturing the apparatus for stretching according to an example embodiment.

FIG. 6 is a process flow diagram showing a method 600 for manufacturing the apparatus 100 according to an example embodiment. The method 600 may be performed manually or by robotic or electromechanical devices commonly used in automobile industry, electronics industry, power tools industry, and so forth. The method 600 may have additional steps not shown herein, but which can be evident for those skilled in the art from the present disclosure. The method 600 may also have fewer steps than outlined below.

The method 600 commences at step 605 with an assembler providing a frame 110. The assembler can refer to an individual, electromechanical device, or both. At step 610, the assembler provides a body holder 105 for connecting to the frame 110. The body holder 105 includes a body support panel 115 for receiving an upper portion of a user's body, a left arm holder 120 for receiving a left arm of the user 305, and a right arm holder 125 for receiving a right arm of the user 305. The left arm holder 120 is configured to be connected to the body support panel 115. The left arm holder 120 has a curved surface to approximate at least a portion of a left side of a torso of the user 305 and to approximate at least a portion of a left arm of the user 305. Similarly, the right arm holder 125 is for connecting to the body support panel 115. The right arm holder 125 has a curved surface to approximate at least a portion of a right side of a torso of the user and to approximate at least a portion of a right arm of the user 305.

At step 615, the assembler connects the body holder 105 to the frame 110 using bolts, screws, latches, arresting devices, welding, and so forth. At step 620, the assembler connects the left arm holder 120 to the body support panel 115 and connects the right arm holder 125 to the body support panel 115 such that the left arm holder 120 and the right arm holder 125 remain pivotally connected to the body support panel 115.

At step 625, the assembler or the user adjusts a tilted angle of the body holder 110 relative to a ground level or the frame 110. For these ends, the assembler or the user needs to operate the fixer 205 and the slider 200 as discussed above. When the apparatus 100 is assembled, the user 305 can use it as follows.

Figure 7:
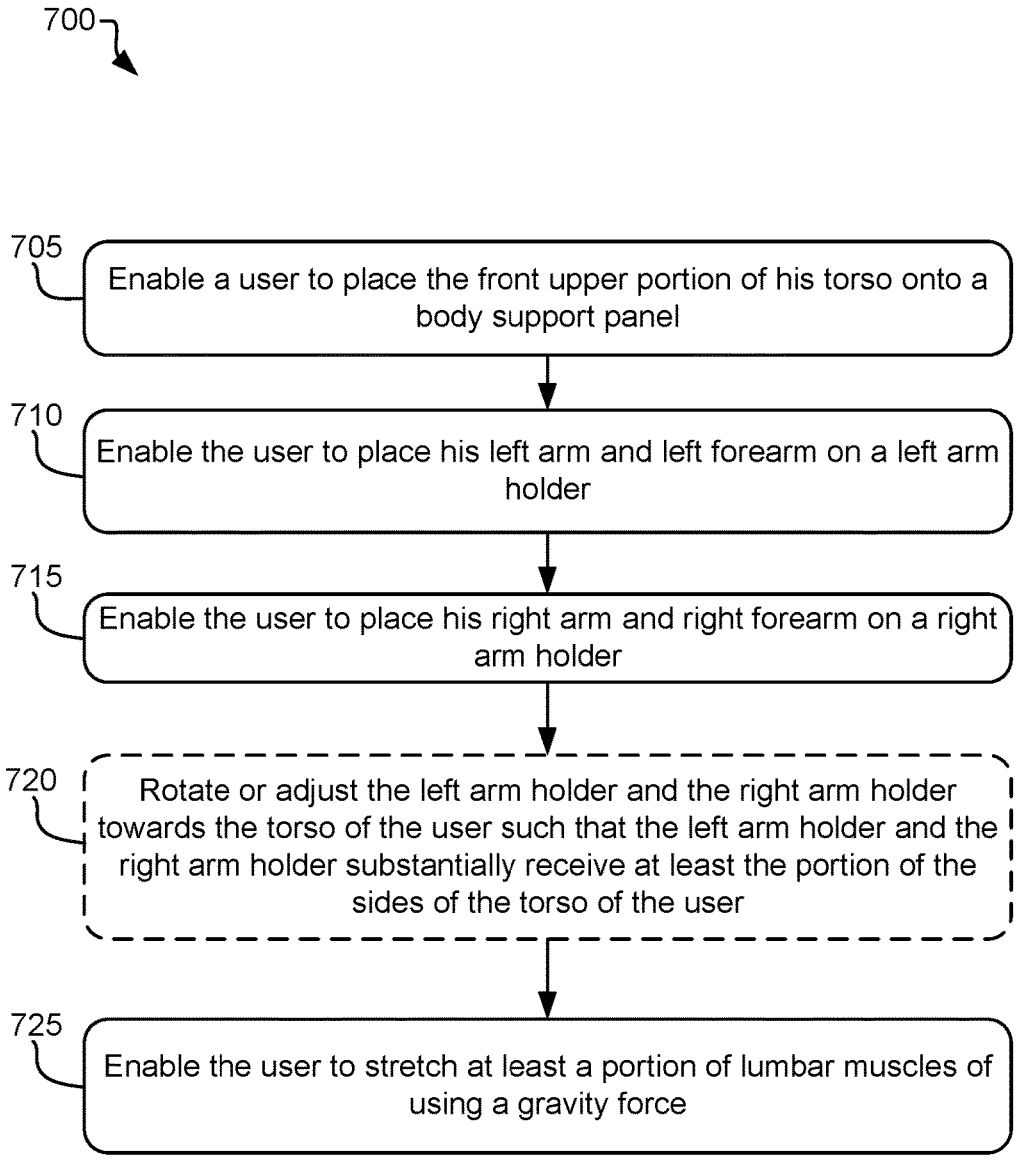
FIG. 7 shows a process flow diagram of a method for using the apparatus for stretching according to an example embodiment.

FIG. 7 shows a process flow diagram of a method 700 for using the apparatus 100 for stretching according to an example embodiment. The method 700 may be performed manually by the user 305 individually or under supervision of a trained professional such as a nurse or therapist. The method 700 may have additional steps not shown herein, but which can be evident for those skilled in the art from the present disclosure. The method 700 may also have fewer steps than outlined below.

The method 700 commences at step 705 with enabling the user 305 to arrange a front upper portion of his torso onto the body support panel 115. For these ends, the user 305 may need to step up on the foot supports 165. The foot supports 165 can be pre-adjusted to a comfortable height for the user 305.

At step 710, the user 305 is enabled to arrange his left arm and left forearm onto the left arm holder 120. The user 305 can also grab one of the handles 190 with his left hand.

At step 715, the user 305 is enabled to arrange his right arm and right forearm onto the right arm holder 125. The user 305 can also grab one of the handles 190 with his right hand.

At optional step 720, the user 305 or therapist rotates or adjusts the left arm holder 120 towards the torso of the user 305 such that the left arm holder 102 substantially receives at least the portion of the left side of the torso of the user 305. Similarly, the user 305 or therapist can rotate or adjust the right arm holder 125 towards the torso of the user 305 such that the right arm holder 125 receives at least the portion of the right side of the torso of the user 305.

At step 725, the user 305 is enabled to stretch at least a portion of lumbar muscles of the user using a gravity force. For these ends, the user needs to release his foot from the foot supports 165 and hang through the body holder 105 and optionally holding the handles 190. The user can stretch for a predetermined period such as 10 seconds, 20 seconds, 30 seconds, 60 seconds, and so forth.

In certain additional embodiments, the apparatus 100 for stretching can also be used as a surgical positioning device or a surgical table to allow performing many spinal surgical procedures, minimally invasive procedures, pain management procedures, and diagnostic radiology. Particularly, the pain management procedures can include, but not limited to, thoracolumbar nerve block injection and treatment, lumbar sacral nerve block injection and treatment, epidural nerve block injection and treatment, injection of medications in epidural or injection of medications in epidural or subdural space. The minimally invasive or surgery procedures can include, but not limited to, kyphoplasty, vertebroplasty, procedures of corrections of intervertebral disks protrusions, facet nerve black, lumbar disk replacement surgery, nephrostomy procedure, and so forth. The diagnostic radiology can include, but not limited to, radio imaging or Magnetic Resonance Imaging (MRI).

Thus, the apparatus for gravity-assisted stretching, the method of its manufacturing, and the method of its using have been described. Although embodiments have been described with reference to specific example embodiments, it will be evident that various modifications and changes can be made to these example embodiments without departing from the broader spirit and scope of the present application. Accordingly, the specification and drawings are to be regarded in an illustrative rather than a restrictive sense.

What is claimed is:

1. An apparatus for stretching, comprising:

a body holder for connecting to a support device, the body holder including:

a body support panel for receiving an upper front portion of a body of a user;

a left arm holder including a first left curved-surface element for contacting at least a portion of a left side of a torso of the user and a second left curved-surface element for receiving a left arm of the user, the first left curved-surface element and the second left curved-surface element being connected substantially perpendicularly towards one another, wherein the left arm holder is pivotally connected to the body support panel; and a right arm holder including a first right curved-surface element for contacting at least a portion of a right side of the torso of the user and a second right curved-surface element for receiving a right arm of the user, the first right curved-surface element and the second right curved-surface element being connected substantially perpendicularly towards one another, wherein the right arm holder is pivotally connected to the body support panel;

wherein the apparatus is configured to support the upper front portion of the body, the left and right arms, and the respective portions of the left and right sides of the torso of the user while the user stretches at least a portion of the lumbar muscles using a gravity force.

2. The apparatus of claim 1, wherein the body support panel has a curved surface to approximate a front part of a torso of the user.

3. The apparatus of claim 1, wherein the body support panel further includes a first padded cushion, the left arm holder includes a second padded cushion, and the right arm holder includes a third padded cushion.

4. The apparatus of claim 1, wherein the first left curved-surface element of the left arm holder approximates at least a portion of the left side of the torso of the user and the second left curved-surface element of the left arm holder approximates at least a portion of the left arm of the user.

5. The apparatus of claim 4, wherein the second left curved-surface element of the left arm holder further approximates at least a portion of a left forearm of the user.

6. The apparatus of claim 1, wherein the first right curved-surface element of the right arm holder approximates at least a portion of the right side of the torso of the user and the second right curved-surface element of the right arm holder approximates at least a portion of the right arm of the user.

7. The apparatus of claim 6, wherein the second right curved-surface element of the right arm holder further approximates at least a portion of a right forearm of the user.

8. The apparatus of claim 1, further comprising the support device.

9. The apparatus of claim 8, wherein the support device includes a ball joint.

10. The apparatus of claim 8, wherein the support device includes a frame.

11. The apparatus of claim 10, wherein the body holder is configured to be tilted from about 90 degrees relative to a horizontal ground level to about 0 degrees relative to the horizontal ground level.

12. The apparatus of claim 10, wherein the body holder is configured to be rotated sideways.

13. The apparatus of claim 10, wherein the frame further includes one or more handles arranged substantially near the left arm holder and the right arm holder enabling the user to grab the one or more handles during a stretching exercise.

14. The apparatus of claim 10, wherein the frame further includes one or more foot supports.

15. The apparatus of claim 10, wherein the frame includes a base and an upper portion of the frame pivotally connected to the base and configured to arrange and fix the upper portion of the frame in a tilted state.

16. The apparatus of claim 15, wherein the upper portion of the frame includes:

two girders pivotally connected to the base;

a crossbar fixed to the girders; and a tilt adjuster.

17. The apparatus of claim 16, wherein the tilt adjuster includes:

a rod, wherein a lower portion of the rod is pivotally connected to the base;

a slider for receiving an upper portion of the rod, wherein the slider is pivotally connected to the crossbar; and a fixer configured to affix the slider to the rod so as to exclude their relative movement.

18. The apparatus of claim 10, wherein the body holder is pivotally connected to the frame.

19. The apparatus of claim 10, wherein the body support panel further includes a support member connected to the frame for preventing breaking the body support panel when in use by the user.

20. The apparatus of claim 1, wherein the body holder is configured to be hung on one or more of the following: a band, a chain, a cable, a rope, and a beam.

21. A method for manufacturing an apparatus for stretching, the method comprising:

providing a support device; and providing a body holder for connecting to the support device, the body holder including:

a body support panel for receiving an upper front portion of a body of a user;

a left arm holder including a first left curved-surface element for contacting at least a portion of a left side of a torso of the user and a second left curved-surface element for receiving a left arm of the user, the first left curved-surface element and the second left curved-surface element being connected substantially perpendicularly towards one another, wherein the left arm holder is for pivotally connecting to the body support panel, and wherein the first left curved-surface element of the left arm holder approximates at least a portion of the left side of the torso of the user and the second left curved-surface element of the left arm holder approximates at least a portion of the left arm of the user; and a right arm holder including a first right curved-surface element for contacting at least a portion of a right side of the torso of the user and a second right curved-surface element for receiving a right arm of the user, the first right curved-surface element and the second right curved-surface element being connected substantially perpendicularly towards one another, wherein the right arm holder is for pivotally connecting to the body support panel, and wherein the first right curved-surface element of the right arm holder approximates at least a portion of the right side of the torso of the user and the second right curved-surface element of the right arm holder approximates at least a portion of the right arm of the user;

wherein the apparatus is configured to support the upper front portion of the body, the left and right arms, and the respective portions of the left and right sides of the torso of the user while the user stretches at least a portion of the lumbar muscles using a gravity force.

22. The method of claim 21, further comprising:

connecting the body holder to the support device; and adjusting a tilted angle of the body holder relative to a ground level or the support device.

23. A method for exercising a body of a user using an apparatus for stretching, the method comprising:

providing a support device;

providing a body holder connected to the support device, the body holder including:

a body support panel for receiving an upper front portion of a body of a user;

a left arm holder including a first left curved-surface element for contacting at least a portion of a left side of a torso of the user and a second left curved-surface element for receiving a left arm of the user, the first left curved-surface element and the second left curved-surface element being connected substantially perpendicularly towards one another, wherein the left arm holder is for pivotally connecting to the body support panel, and wherein the first left curved-surface element of the left arm holder approximates at least a portion of the left side of the torso of the user and the second left curved-surface element of the left arm holder approximates at least a portion of the left arm of the user; and a right arm holder including a first right curved-surface element for contacting at least a portion of a right side of the torso of the user and a second right curved-surface element for receiving a right arm of the user, the first right curved-surface element and the second right curved-surface element being connected substantially perpendicularly towards one another, wherein the right arm holder is for pivotally connecting to the body support panel, and wherein the first right curved-surface element of the right arm holder approximates at least a portion of the right side of the torso of the user and the second right curved-surface element of the right arm holder approximates at least a portion of the right arm of the user;

enabling the user to arrange a front portion of the torso of the user onto the body support panel;

enabling the user to arrange the left arm and a left forearm onto the left arm holder;

enabling the user to arrange the right arm and a right forearm onto the right arm holder;

rotating or adjusting the left arm holder towards the torso of the user such that the first left curved-surface element of the left arm holder receives at least the portion of the left side of the torso of the user;

rotating or adjusting the right arm holder towards the torso of the user such that the first right curved-surface element of the right arm holder receives at least the portion of the right side of the torso of the user;

enabling the user to grab at least one handle on the support device; and enabling the user to stretch at least a portion of lumbar muscles of the user using a gravity force.

* * * * *